US012145078B2

(12) United States Patent
Xie

(10) Patent No.: US 12,145,078 B2
(45) **Date of Patent: *Nov. 19, 2024**

(54) MAGNETIC TOY

(71) Applicant: Shenzhen Jiaxin Technology Co., Ltd, Shenzhen (CN)

(72) Inventor: Penghui Xie, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/365,923

(22) Filed: Aug. 4, 2023

(65) Prior Publication Data

US 2024/0149183 A1 May 9, 2024

(30) Foreign Application Priority Data

Nov. 9, 2022 (CN) ..... 202222985502.7
Jul. 11, 2023 (CN) ..... 202321809110.3

(51) Int. Cl.
*A63H 33/26* (2006.01)
*A63H 33/04* (2006.01)

(52) U.S. Cl.
CPC ..... *A63H 33/046* (2013.01)

(58) Field of Classification Search
CPC ..... A63H 33/046
See application file for complete search history.

(56) References Cited

U.S. PATENT DOCUMENTS 5,599,188 A * 2/1997 Lemos Melendez .. G09B 19/02 434/211
9,022,829 B2 * 5/2015 Rosen ..... A63H 33/046 446/131
9,636,600 B2 * 5/2017 Rudisill ..... A63H 33/046
9,643,100 B2 * 5/2017 Fein ..... A63H 33/046
10,245,523 B2 * 4/2019 Lin ..... A63H 33/26
11,527,344 B2 * 12/2022 Kuo ..... E04B 1/612
11,642,604 B1 * 5/2023 Xie ..... A63H 33/046 446/92
2012/0015583 A1 * 1/2012 Chen ..... A63H 33/086 446/124
2012/0270465 A1 * 10/2012 Park ..... A63H 33/046 206/338
2013/0267145 A1 * 10/2013 Rosen ..... A63H 33/046 446/92

(Continued)

FOREIGN PATENT DOCUMENTS

KR 101491599 B1 * 2/2015 ..... A63H 33/10

OTHER PUBLICATIONS

Young, Machine Translation of KR-101491599-B1, uploaded Oct. 3, 2023, Espacenet, 3 pages.*

*Primary Examiner* — Eugene L Kim
*Assistant Examiner* — Matthew B Stanczak

(57) ABSTRACT

The present disclosure provides a magnetic toy. The magnetic toy includes a mounting bracket, a magnetic member, a base and a cover body. The mounting bracket includes a plurality of clamping members, two adjacent clamping members are connected to form the mounting bracket. The clamping portions are provided with mounting columns and the clamping space is formed between two opposite mounting columns. The magnet is rotatably arranged in the iron tube and the iron tube sleeves the mounting columns. The base and the cover body are respectively connected to two sides of the mounting bracket. The iron tube is arranged into the gaps.

20 Claims, 18 Drawing Sheets

(56) References Cited

U.S. PATENT DOCUMENTS

| | | | | |
|---|---|---|---|---|
| 2015/0231521 | A1* | 8/2015 | Peterson | B29C 65/56 446/92 |
| 2016/0074766 | A1* | 3/2016 | Choi | A63H 33/046 446/92 |
| 2017/0065899 | A1* | 3/2017 | Moskowitz | A63H 33/046 |
| 2017/0136381 | A1* | 5/2017 | Wei | A63H 33/042 |
| 2017/0232357 | A1* | 8/2017 | Rosen | A63H 33/046 446/92 |
| 2019/0275440 | A1* | 9/2019 | Eshet | A63H 33/12 |
| 2020/0147508 | A1* | 5/2020 | Romanoff | A63H 33/086 |
| 2020/0406156 | A1* | 12/2020 | Rosen | A63H 33/042 |
| 2021/0213369 | A1* | 7/2021 | Yamaai | A63H 33/046 |
| 2022/0297021 | A1* | 9/2022 | Liu | A63H 33/22 |
| 2023/0011988 | A1* | 1/2023 | Wang | A63H 33/042 |

* cited by examiner

MAGNETIC TOY

CROSS-REFERENCE TO RELATED APPLICATIONS

The application claims priority of Chinese patent applications No. 2022229855027, filed on 2022 Nov. 9, and No. 2023218091103, filed on 2023 Jul. 11, which are incorporated herein by reference in there entireties.

TECHNICAL FIELD

The present disclosure relates to the technical field of toy blocks, and in particular to, a magnetic toy.

BACKGROUND

Three-dimensional (3D) magnetic puzzle blocks have been increasingly popular toys in recent years, and can be assembled into various three-dimensional modelings, which help develop children's imagination, hand-eye coordination ability, and innovation ability. They are extremely popular.

In most of existing magnetic toys on the current market, a magnet is arranged in an internal cavity of a plastic shell. A magnetic force of the magnet through inner walls of two layers of plastic becomes relatively low, resulting in a low magnetic force. As a result, it is hard to stably connect the magnetic toys. The magnetic toys can build a limited number of three-dimensional modelings, and has low playability, which greatly affects the user experience. In some products, a fixing member is actually placed in a hollow shell to fix the magnet, but due to the fact that shells of most of these products are hollowed, the strength is poor. Therefore, there is an urgent need for providing a magnetic toy with a low price, high acceptability, strong magnetic force, high strength, high safety and high playability, which is convenient for users to put out magnetic toys of various modelings to improve the user experience.

Therefore, this invention provides a magnetic toy that can effectively solve the above problems. The magnetic toy has a simple structure and high magnetic strength, and is firm and durable.

SUMMARY

In order to overcome the shortcomings of the prior art, the present disclosure provides a magnetic toy, which has a simple structure and high magnetic strength, and is firm and durable.

The technical solution adopted by the present disclosure to solve the technical problem is as follows: a magnetic toy includes a mounting bracket, wherein the mounting bracket includes a plurality of clamping members; two adjacent clamping members are connected to form the mounting bracket; a clamping portion is arranged at an end portion of each of the clamping members; a clamping space is formed between the two clamping portions on the two adjacent clamping members; a magnetic member, wherein the magnetic member is arranged in the clamping space, wherein the magnetic member includes an iron tube and a magnet; the magnet is arranged in the iron tube; two adjacent mounting columns in the clamping space are respectively clamped to two ends of the iron tube; a base, wherein the base is connected to one side of the mounting bracket; and a cover body, wherein the cover body is connected to the other side of the mounting bracket and is covered on the base; wherein the base and the cover body are both provided with gaps; the gaps correspond to the clamping space; and when the base and the cover body are connected to the mounting bracket, at least part of the iron tube is arranged into the gaps.

As the improvement of the present disclosure, the clamping portions are provided with mounting columns; the mounting columns are arranged in a manner of facing the mounting space; the magnet is rotatably arranged in the iron tube; and the two ends of the iron tube respectively sleeve the two adjacent mounting columns.

As the improvement of the present disclosure, the base is further provided with a positioning column; the mounting bracket is provided with a positioning hole; when the positioning hole sleeves the positioning column, the cover body is covered on the base to top the mounting bracket in the base and to stop the magnetic member in the gaps.

As the improvement of the present disclosure, the position column includes a first positioning column unit and a second positioning column unit, the positioning hole includes a first positioning hole unit and a second positioning hole unit, the cover body is provided with a stop edge; and when the cover body is covered on the base, the stop edge abuts against the first positioning column unit and the second positioning column unit to stop the first positioning column unit in the first positioning hole unit and stop a second positioning column unit in the second positioning hole unit, so that the magnetic member is stopped in the gaps.

As the improvement of the present disclosure, abutment platforms are arranged at joints of the mounting columns and the clamping members; and when the iron tube sleeves the mounting columns, end portions of the iron tube abut against the abutment platforms.

As the improvement of the present disclosure, a diameter of a connecting end of each of the mounting columns is greater than a diameter of a free end of the mounting column.

As the improvement of the present disclosure, a guide cambered surface is arranged at a free end of each of the mounting columns.

As the improvement of the present disclosure, the magnet is columnar; a diameter of the magnet matches an inner diameter of the iron tube; an axial direction of the magnet matches an axial direction of the iron tube; and the magnet rotates in the iron tube around the axial direction of the magnet.

As the improvement of the present disclosure, a connecting block is arranged at a first end of each of the clamping members; a connecting slot is formed in a second end of the clamping member; and the connecting block on one of the clamping members is plugged into the connecting slot on the neighboring clamping member.

As the improvement of the present disclosure, one side of an axis of the magnet is an S pole, and the other side of the axis of the magnet is an N pole.

As the improvement of the present disclosure, a transverse length of the iron tube is greater than a transverse length of the magnet; and a space exists between an end portion of the magnet and a free end of each of the mounting columns.

As the improvement of the present disclosure, a mounting convex block is arranged on an inner side of the cover body; a mounting groove is formed in an inner side of the base; and when the cover body is connected to the other side of the mounting bracket and is covered on the base, the mounting convex block is plugged into the mounting groove.

As the improvement of the present disclosure, a connecting portion is arranged at a position, close to each of the mounting columns, of each of the clamping members in a protruding manner; abutment blocks are arranged on an inner side of the cover body and/or an inner side of the base; and when the cover body is connected to the other side of the mounting bracket and is covered on the base, the abutment blocks abut against an end surface of the connecting portion.

As the improvement of the present disclosure, a connecting board is arranged at an edge of each of the clamping members in a protruding manner; and when the cover body is connected to the other side of the mounting bracket and is covered on the base, an outer edge of the cover body and/or an outer edge of the base abut against and are connected to an inner side of the connecting board.

As the improvement of the present disclosure, connecting edges are arranged at an edge of an outer surface of the cover body and/or an edge of an outer surface of the base; and at least part of the connecting edges abut against and is connected to an inner side of the connecting board.

As the improvement of the present disclosure, reinforcing ribs are arranged in the middle of a surface of the cover body and/or in the middle of a surface of the base in a protruding manner.

As the improvement of the present disclosure, connecting cambered surfaces are arranged at an edge of an inner side of the cover body and/or an edge of an inner side of the base; and the two connecting cambered surfaces are connected to form a central through hole.

As the improvement of the present disclosure, an arc-shaped transition surface is arranged on an outer edge of each of the clamping members; and the arc-shaped transition surface matches an outer surface of the iron tube.

As the improvement of the present disclosure, a transition curved surface is arranged at an edge of the connecting board; and the transition curved surface is used to allow the connecting edge to slide along the transition curved surface.

As the improvement of the present disclosure, each of the clamping members is a plastic clamping member.

Beneficial effects: due to the arrangement of the above structure, during use, the clamping members are connected to one another in sequence to form the mounting bracket. Angles between two edges of different types of clamping members are different, so that magnetic toys in different shapes with the mounting brackets can be formed, for example, a triangular magnetic toy, a rectangular attraction toy, a trapezoid attraction toy, or a hexagonal attraction toy. Users have more assembling choices on the magnetic toys in various shapes, which improves the fun of the product. The mounting columns are arranged on the outer sides of the end portions of the clamping members. After all the clamping members are connected, the clamping space is formed between two opposite mounting columns. The magnet is arranged in the iron tube. A first end of the iron tube sleeves the mounting column on one clamping member, and a second end of the iron tube sleeves the mounting column on the other clamping member. The two clamping members are connected to stably connect the two ends of the iron tube to the two mounting columns. When the magnet is arranged in the iron tube, the magnet can rotate in the iron tube. Under the action of a magnetic force, an orientation of a magnetic pole of the magnet can be automatically adjusted. An N pole of one magnetic toy attracts an S pole of another identical magnetic toy, or an S pole of the magnetic toy attracts an N pole of the another identical magnetic toy, so as to achieve stable connection between the magnetic toys. Meanwhile, the iron tube can shrink magnetic induction lines around the magnet, so that the magnetic induction lines around the magnet are distributed more densely, and the magnetic induction intensity of a surface of the iron tube is improved. When two adjacent iron tubes get close to each other, a magnetic force between the two iron tubes is higher, which further improves the stability of connection of the magnetic toys and improves the use experience of a user. The base and the cover body are respectively connected to two sides of the mounting bracket, so that all the clamping members can be fixed and are prevented from being separated from one another, which improves the stability of the product. Furthermore, the base, the cover body, and the mounting bracket can be in different colors. When the base and the cover body are connected to the two sides of the mounting bracket, edges of the clamping members are exposed between the base and the cover body to form a sandwich shape. There may be more colors matching each other, so that the product has a more attractive appearance and richer colors. Preferably, the base and the cover body are respectively connected to the two sides of the mounting bracket in an ultrasonic welding manner. When ultrasonic waves act on thermoplastic plastic contact surfaces, tens of thousands of high-frequency vibrations per second will be generated. The high-frequency vibration waves are transmitted to a surface of the mounting bracket, a surface of the base, and a surface of the cover body. A local high temperature may be caused due to a high acoustic resistance at interfaces of the surface of the mounting bracket and the surfaces of the base and cover body. As plastic has poor thermal conductivity, heat cannot be dissipated in time and is accumulated in a welding region. As a result, the interfaces of the surface of the mounting bracket and the surfaces of the base and cover body are quickly melted. Furthermore, a certain pressure is applied. After the action of the ultrasonic waves stops, the pressure is last for several seconds, so that the interfaces are solidified and molded. In this way, the mounting bracket, the base, and the cover body form a whole. The welding purpose is achieved. The welding strength can be close to the strength of an original material. Moreover, welding lines can be reduced. In a case of guaranteeing the connection strength, the product has a more attractive appearance.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

First Embodiment

Figure 1:
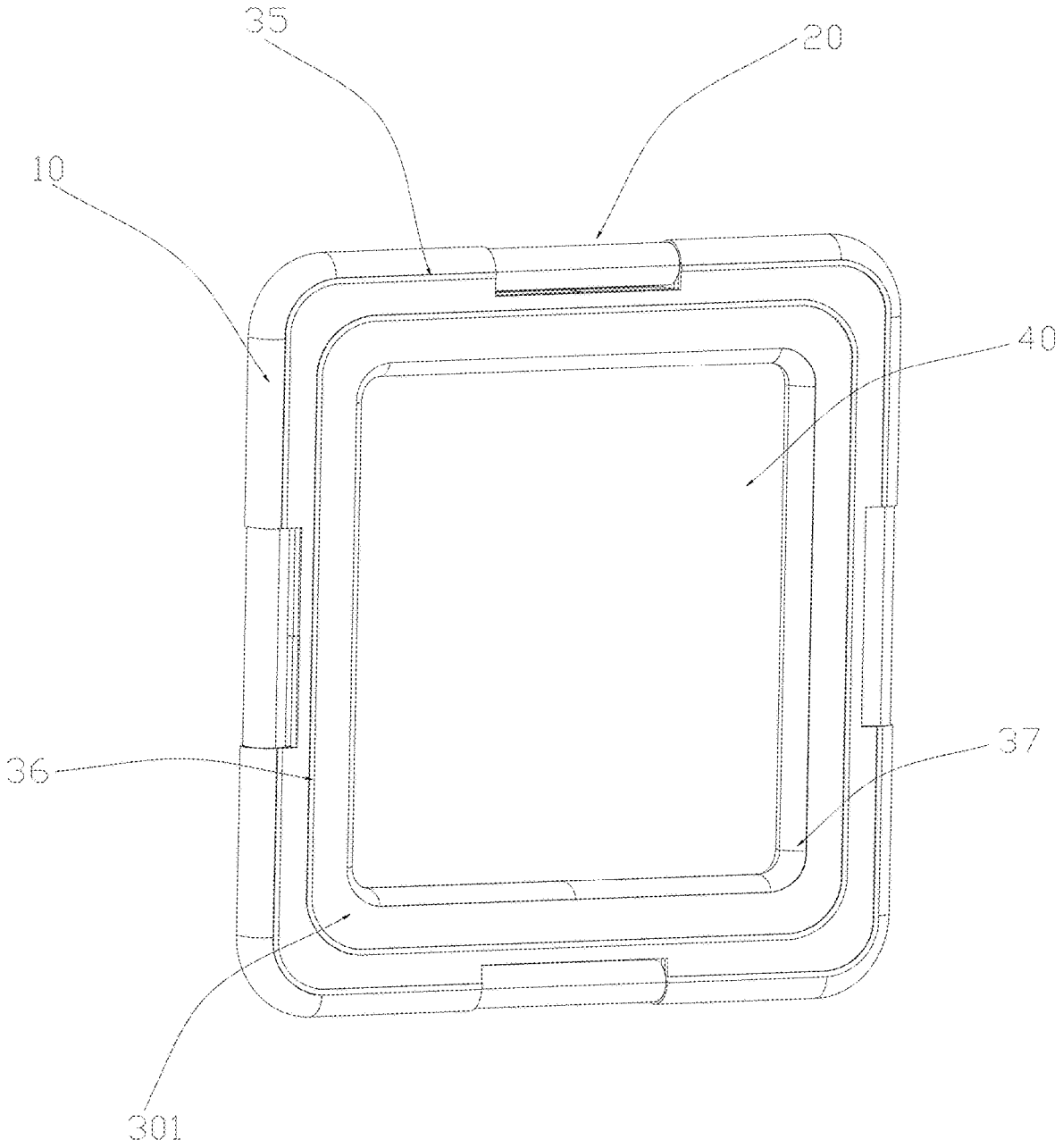
FIG. 1 is a schematic diagram of an entire structure of a first shape according to a first embodiment of the present disclosure.
Figure 2:
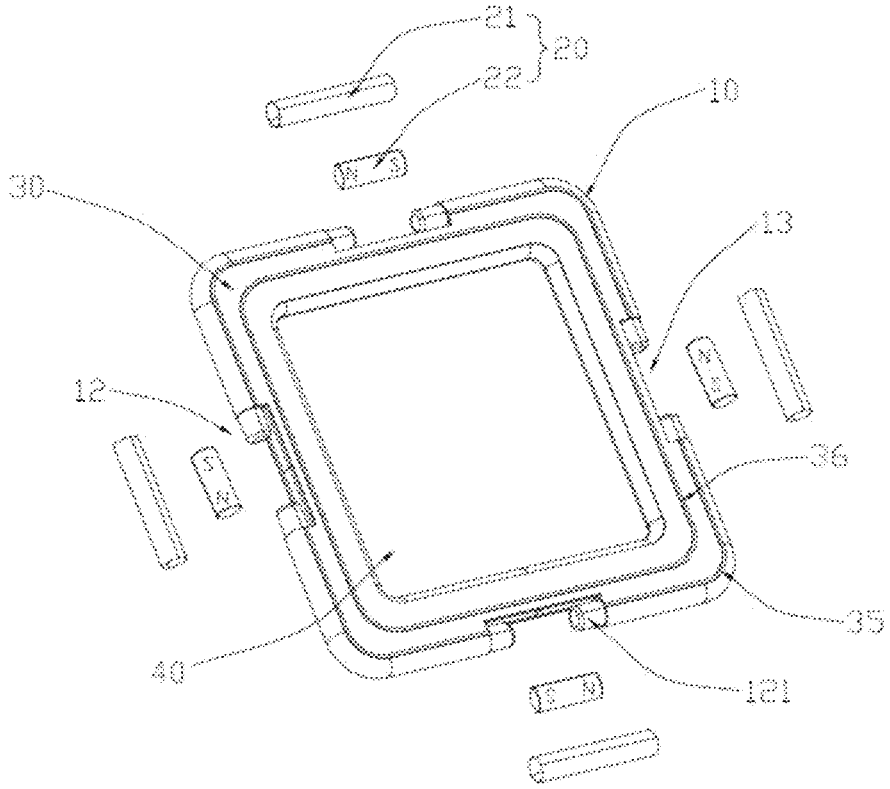
FIG. 2 is a schematic diagram of a first exploded structure according to a first embodiment of the present disclosure.
Figure 3:
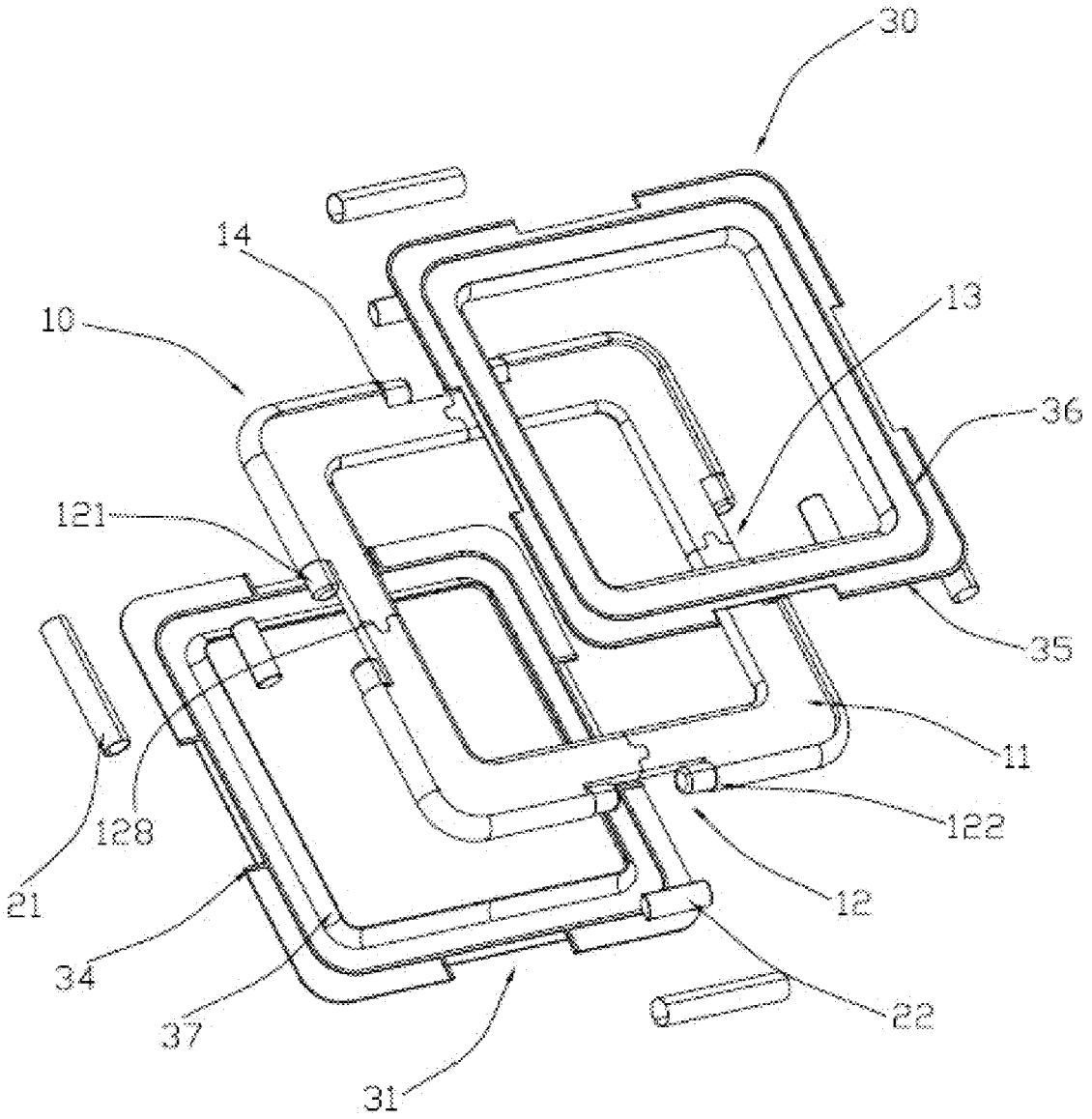
FIG. 3 is a schematic diagram of a second exploded structure according to a first embodiment of the present disclosure.
Figure 4:
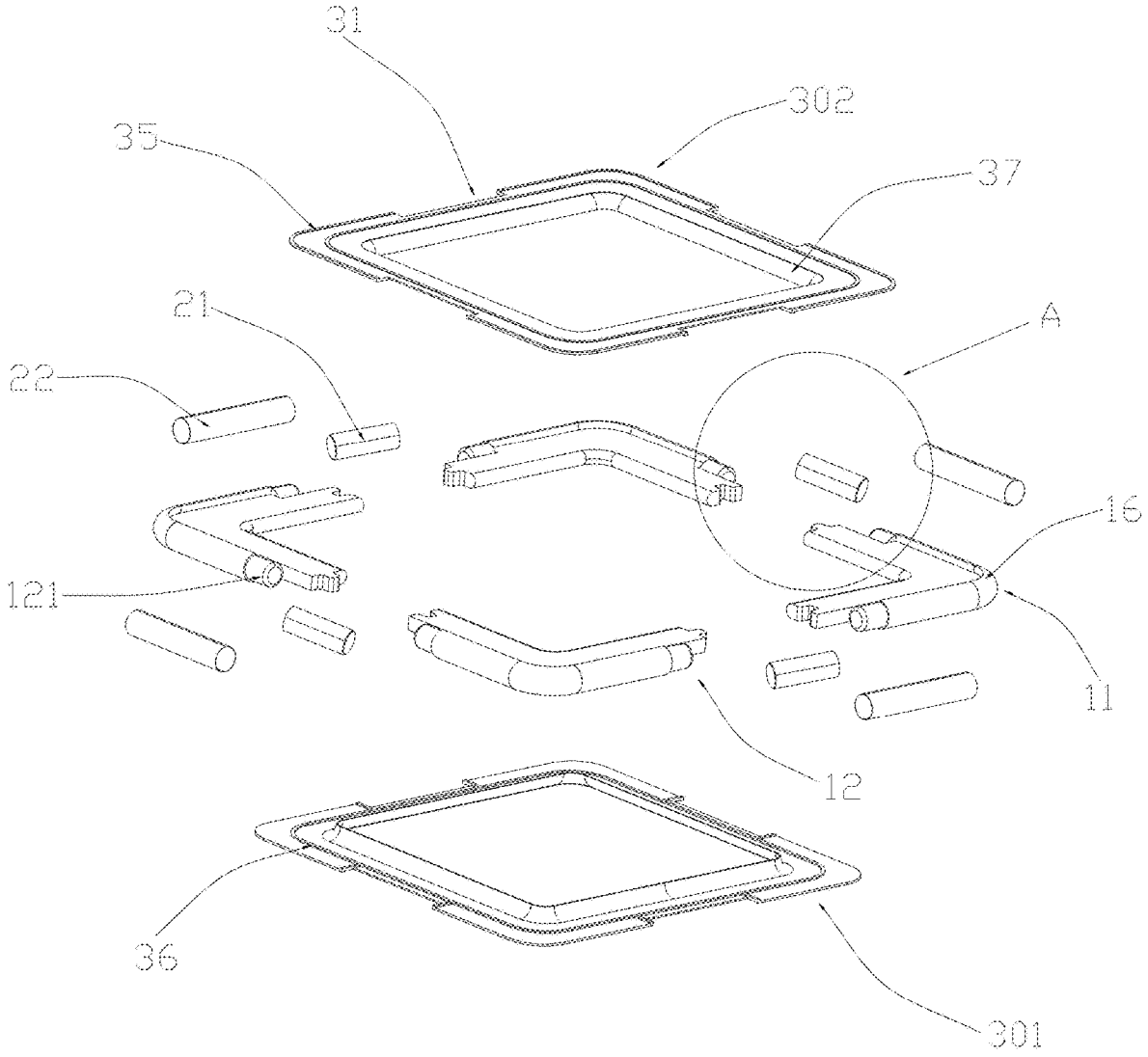
FIG. 4 is a schematic diagram of a third exploded structure according to a first embodiment of the present disclosure.
Figure 5:
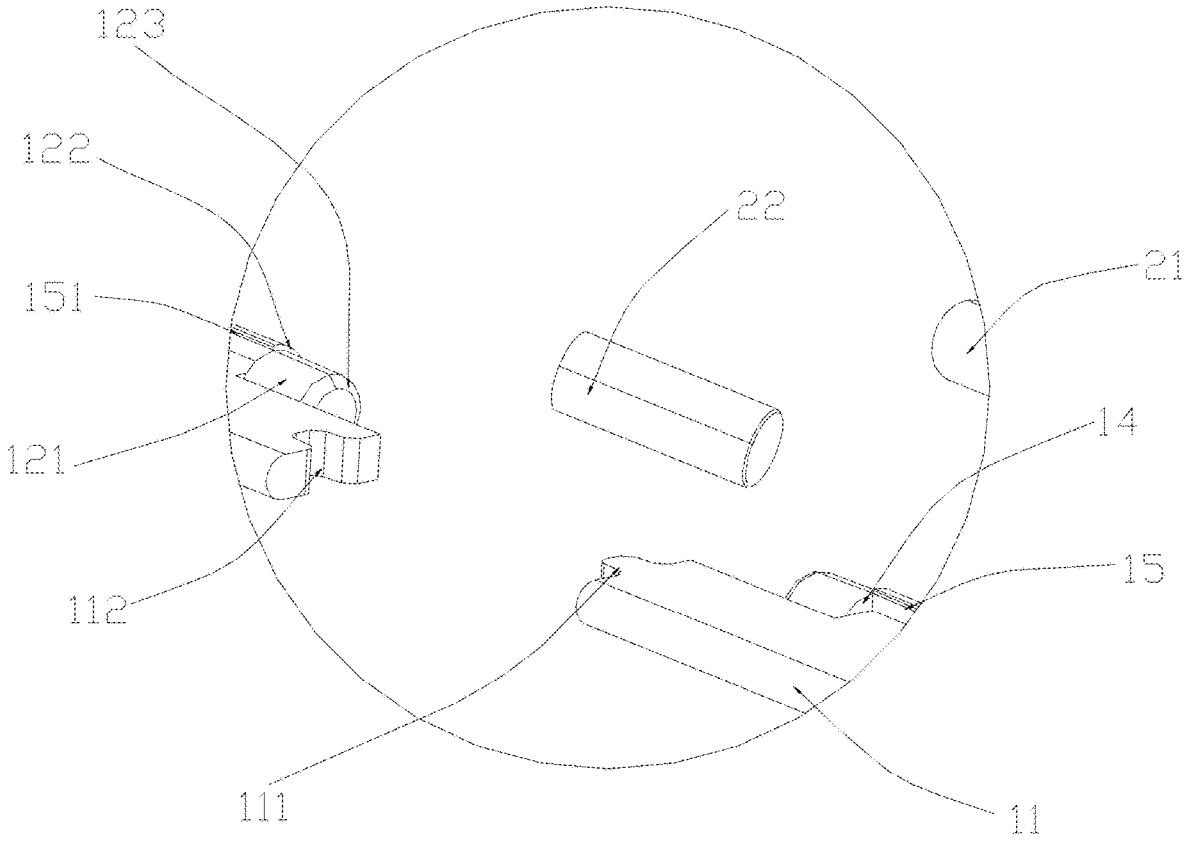
FIG. 5 is an enlarged diagram of the circle A in FIG. 4.
Figure 6:
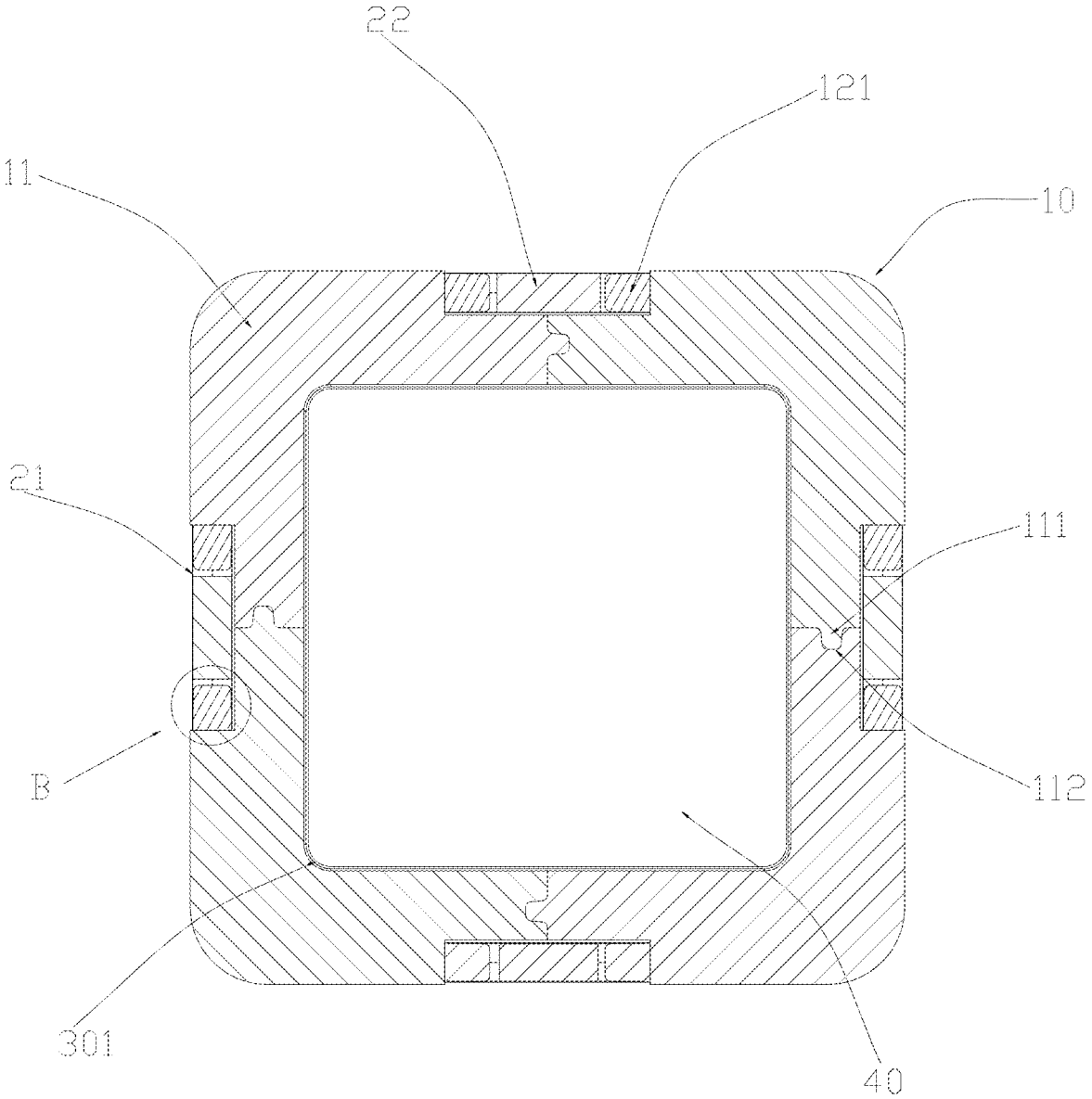
FIG. 6 is a sectional diagram of a first embodiment of the present disclosure.
Figure 7:
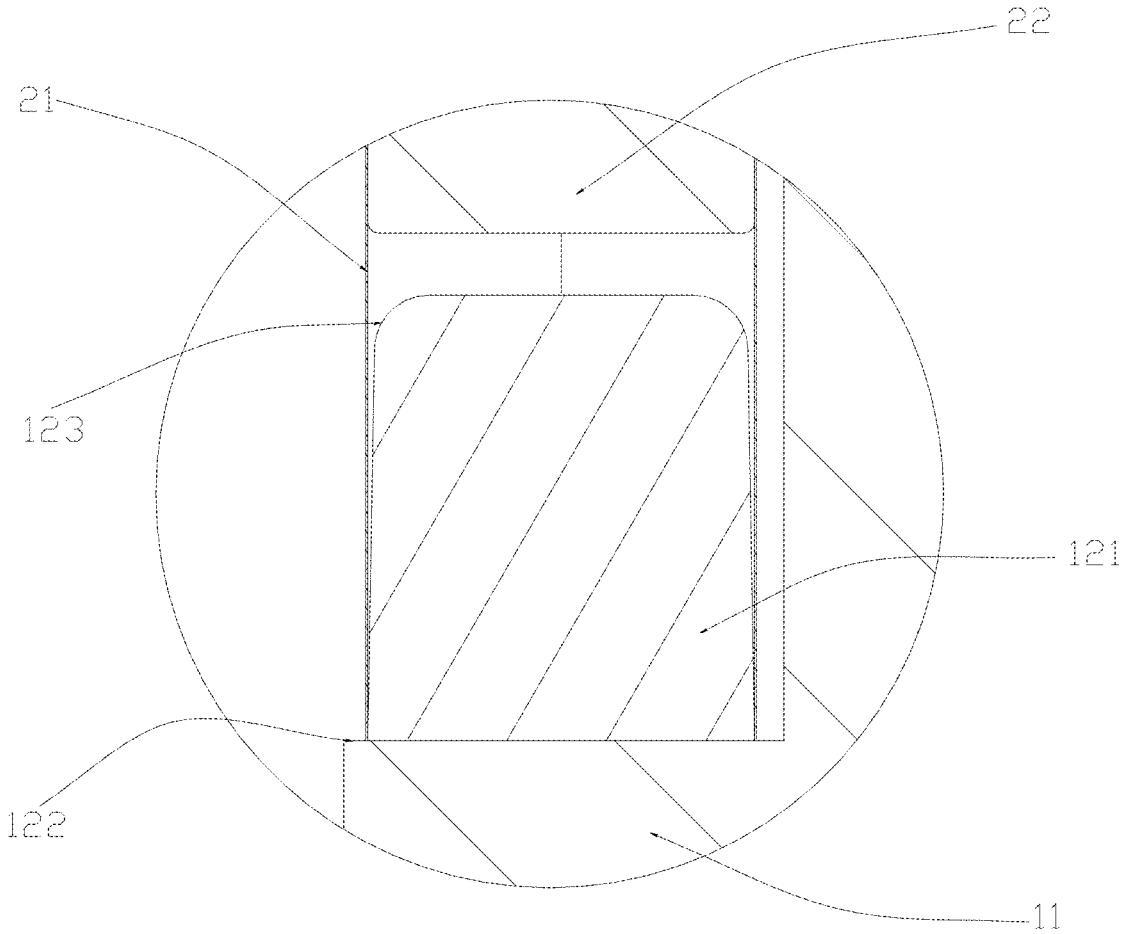
FIG. 7 is an enlarged diagram of the circle B in FIG. 6.
Figure 8:
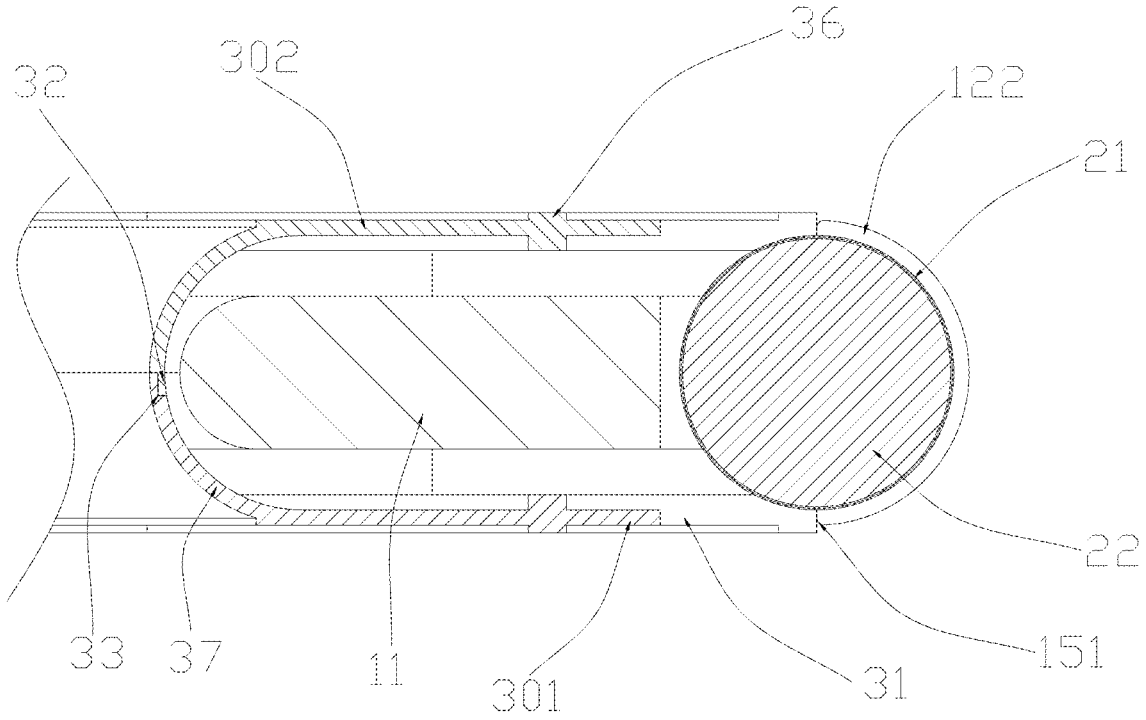
FIG. 8 is a first partially sectional diagram of a first embodiment of the present disclosure.
Figure 9:
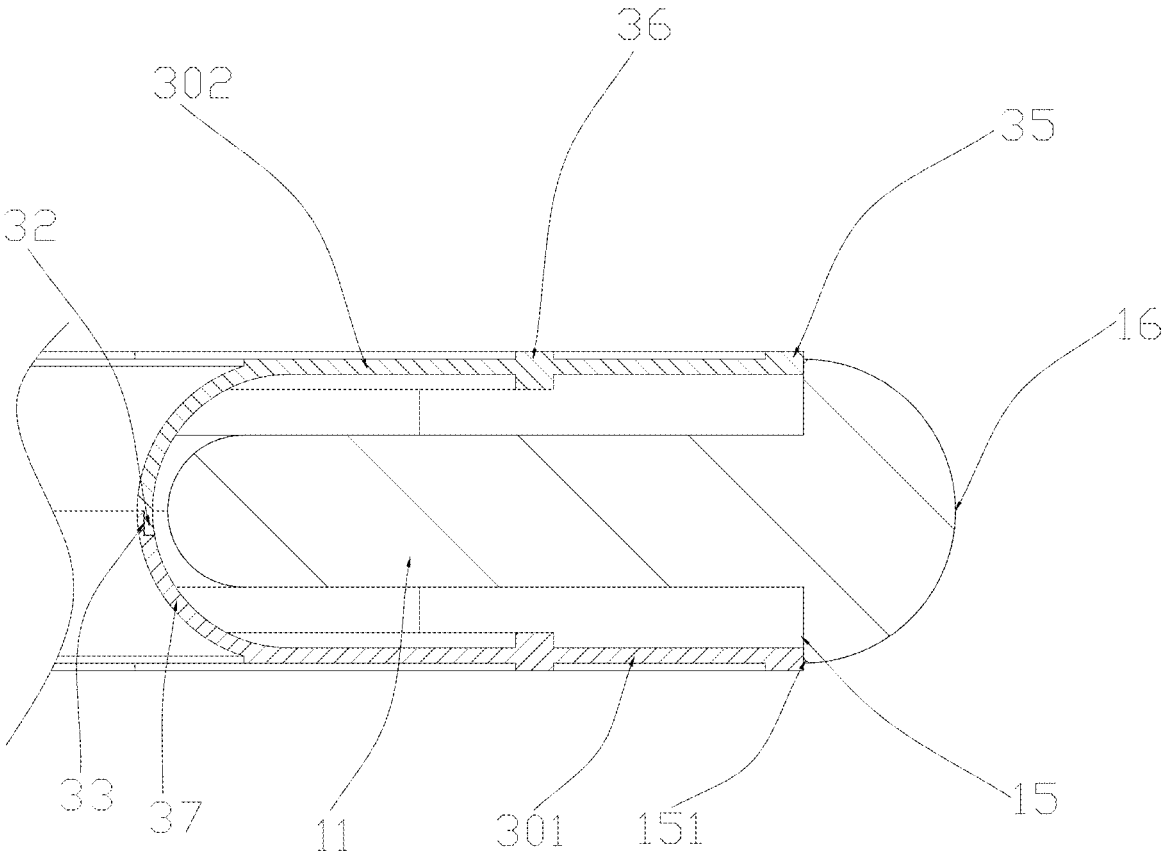
FIG. 9 is a second partially sectional diagram of a first embodiment of the present disclosure.

Referring to FIG. 1 to FIG. 12, a magnetic toy includes:

a mounting bracket 10, wherein the mounting bracket 10 includes a plurality of clamping members 11; two adjacent clamping members 11 are connected to form the mounting bracket 10;

a clamping portion 12 is arranged at an end portion of each of the clamping members 11; a clamping space 13 is formed between the two clamping portions 12 on the two adjacent clamping members 11;

a magnetic member 20, wherein the magnetic member 20 is arranged in the clamping space 13, wherein the magnetic member 20 includes an iron tube 21 and a magnet 22; the magnet 22 is arranged in the iron tube 21; two adjacent mounting columns 121 in the clamping space 13 are respectively clamped to two ends of the iron tube 21;

a base 301, wherein the base 301 is connected to one side of the mounting bracket 10; and a cover body 302, wherein the cover body 302 is connected to the other side of the mounting bracket 10 and is covered on the base 301;

wherein the base 301 and the cover body 302 are both provided with gaps 31; the gaps 31 correspond to the clamping space 13; and when the base 301 and the cover body 302 are connected to the mounting bracket 10, at least part of the iron tube 21 is arranged into the gaps 31.

In this embodiment, the clamping portions 12 are provided with mounting columns 121; the mounting columns 121 are arranged in a manner of facing the mounting space 13; the magnet 22 is rotatably arranged in the iron tube 21; and the two ends of the iron tube 21 respectively sleeve the two adjacent mounting columns 121. The iron tube 21 has a closed circle in cross section.

Figure 10:
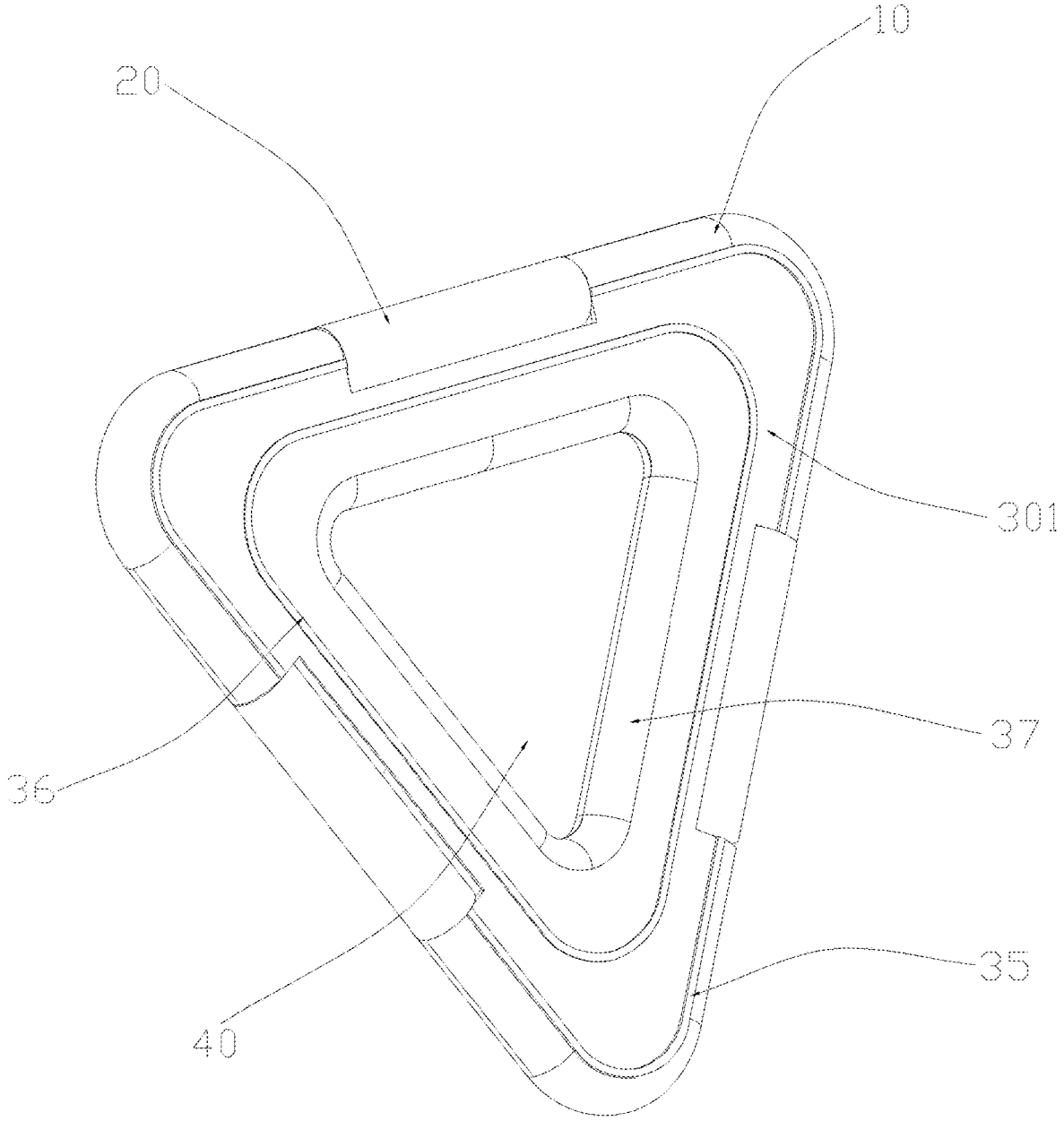
FIG. 10 is a schematic diagram of an entire structure of a second shape according to a first embodiment of the present disclosure.
Figure 11:
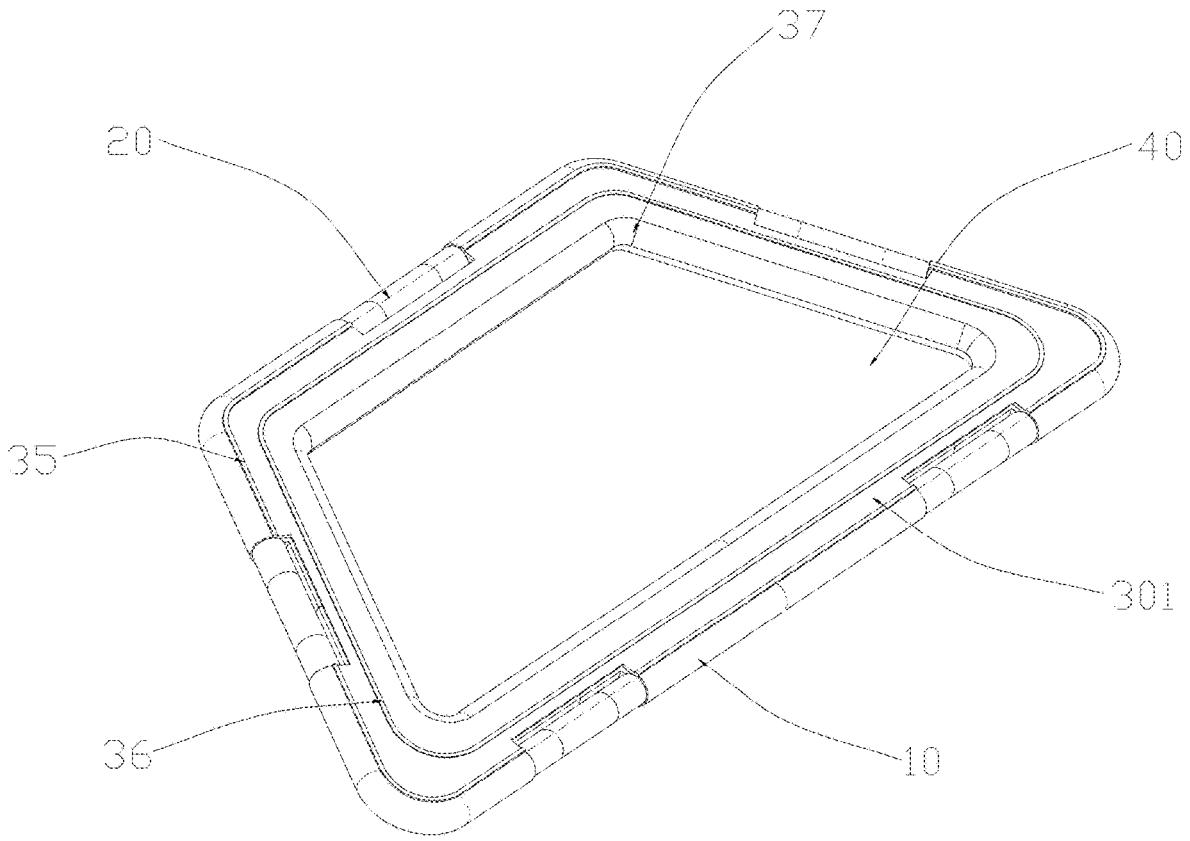
FIG. 11 is a schematic diagram of an entire structure of a third shape according to a first embodiment of the present disclosure.
Figure 12:
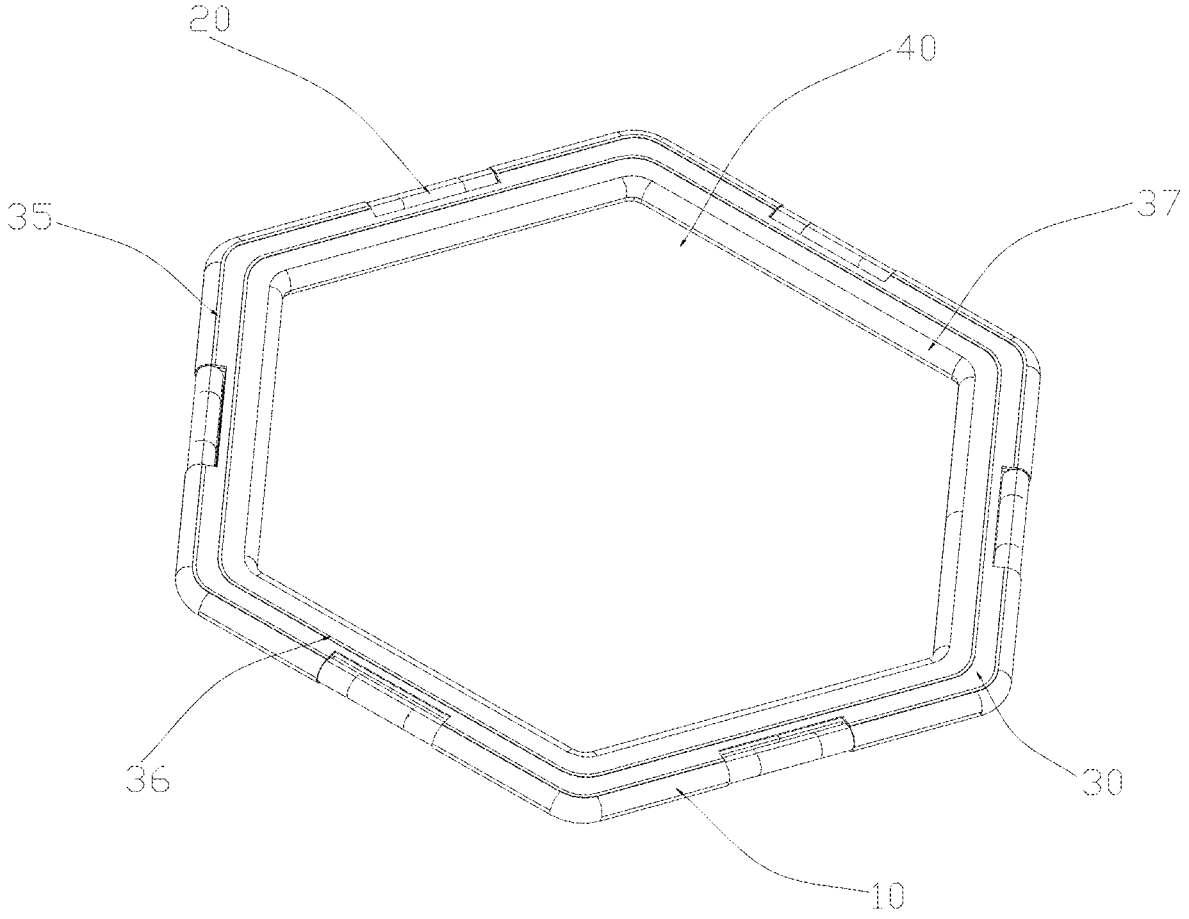
FIG. 12 is a schematic diagram of an entire structure of a fourth shape according to a first embodiment of the present disclosure.
Figure 13:
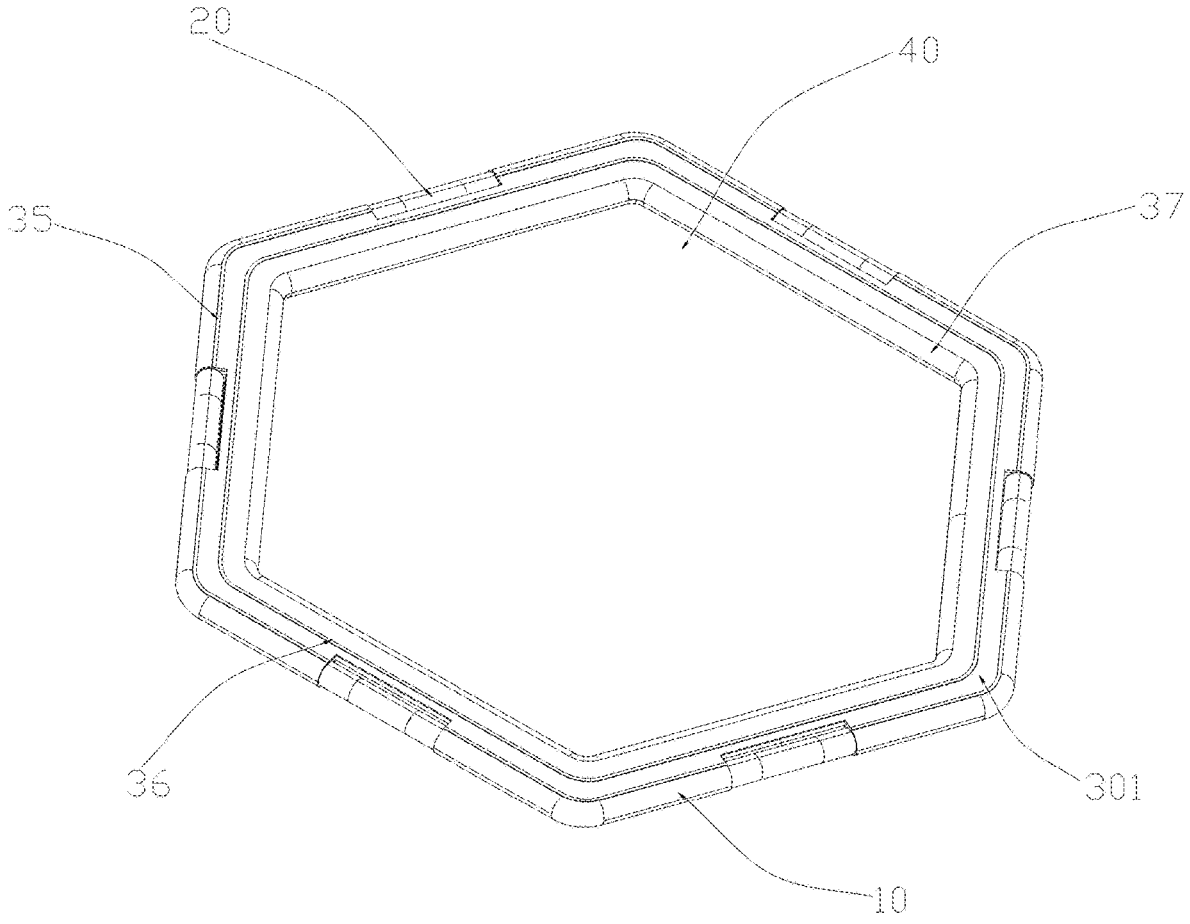
FIG. 13 is a schematic diagram of an overall structure of a second embodiment of the present disclosure.
Figure 14:
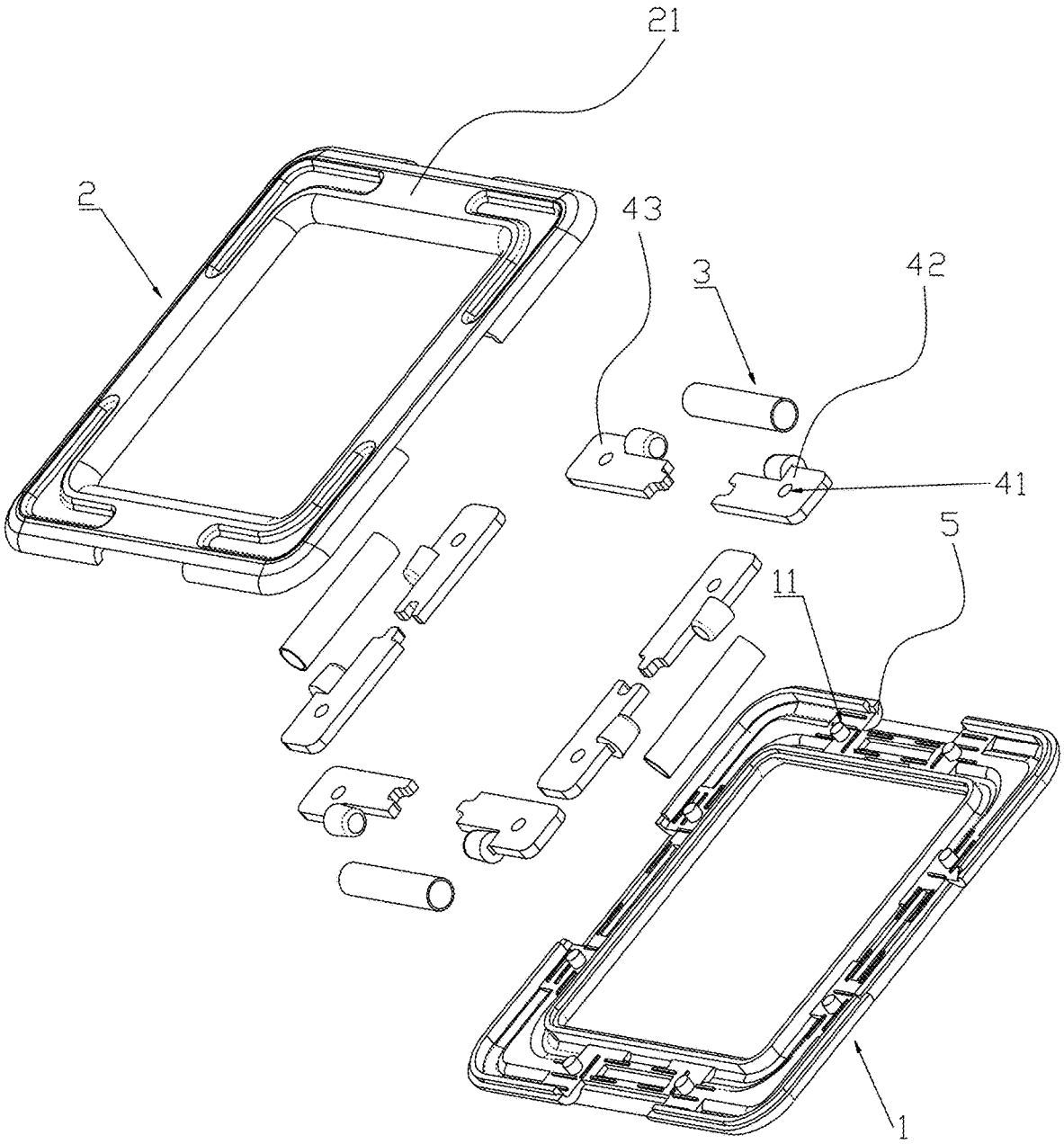
FIG. 14 is an exploded diagram of a second embodiment of the present disclosure.
Figure 15:
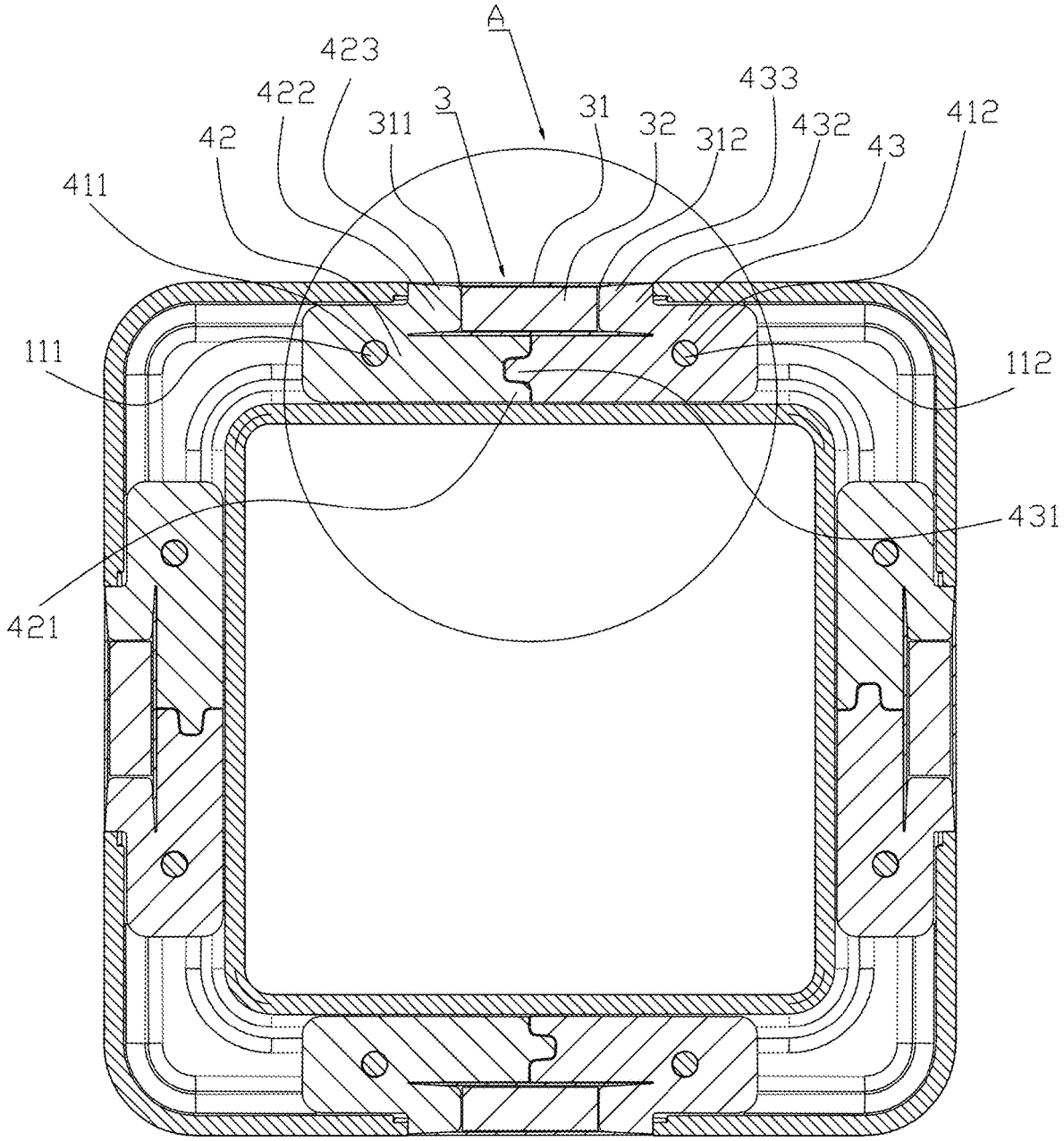
FIG. 15 is a sectional view of sectioning along a mounting frame and a magnetic attraction member of a second embodiment of the present disclosure.
Figure 16:
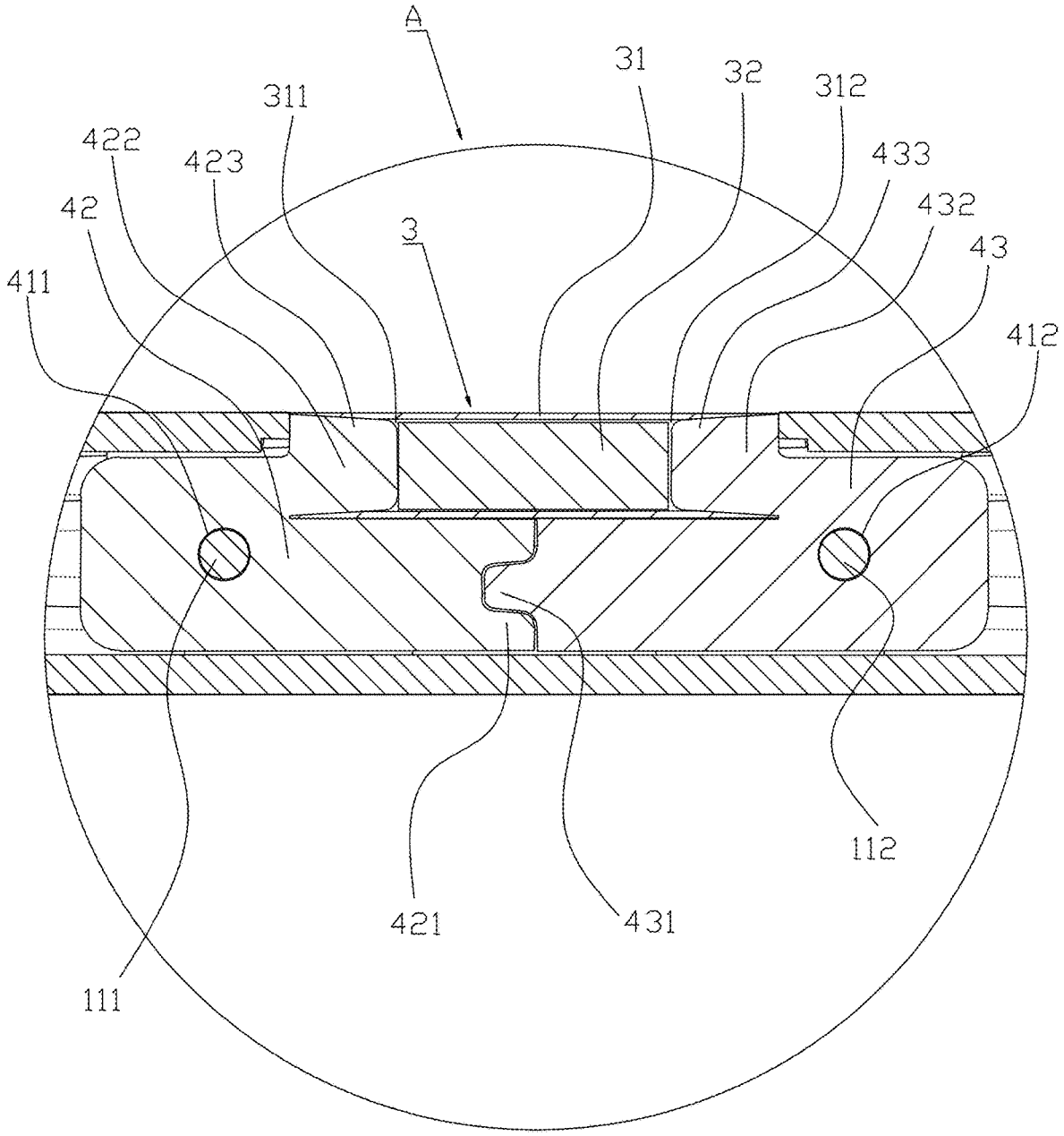
FIG. 16 is an enlarged diagram of the part A of FIG. 15.
Figure 17:
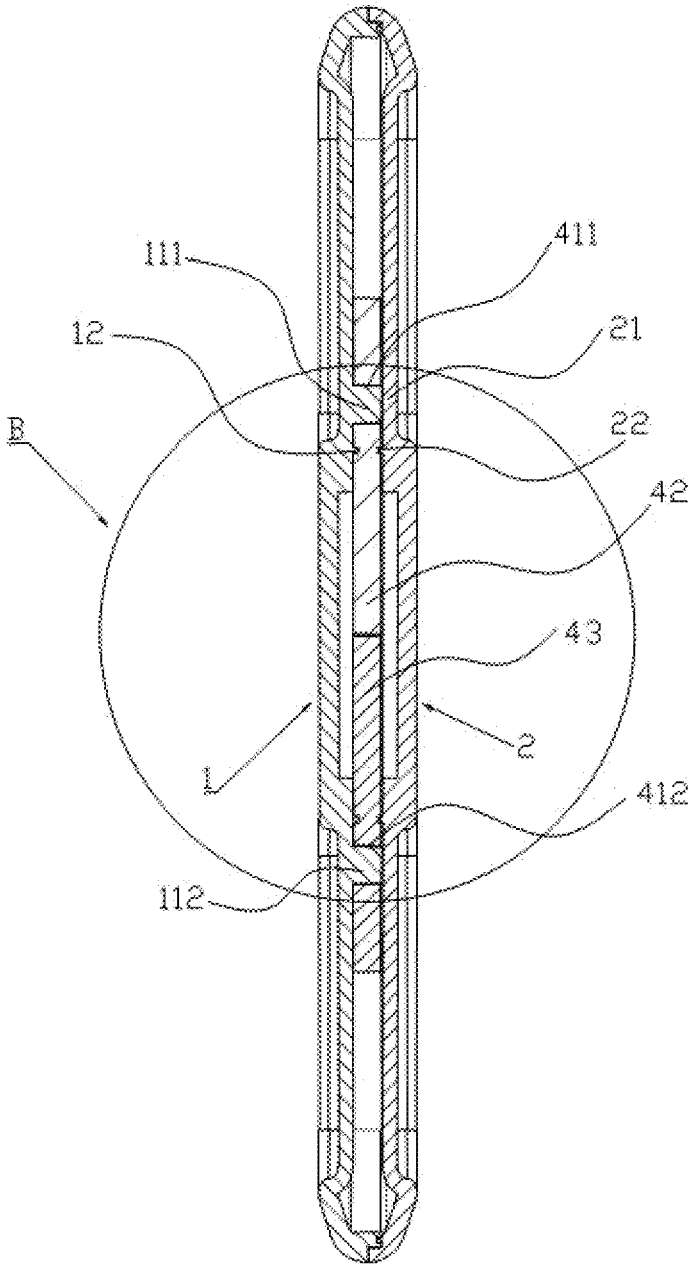
FIG. 17 is a sectional view of sectioning along locating pillars and locating holes.
Figure 18:
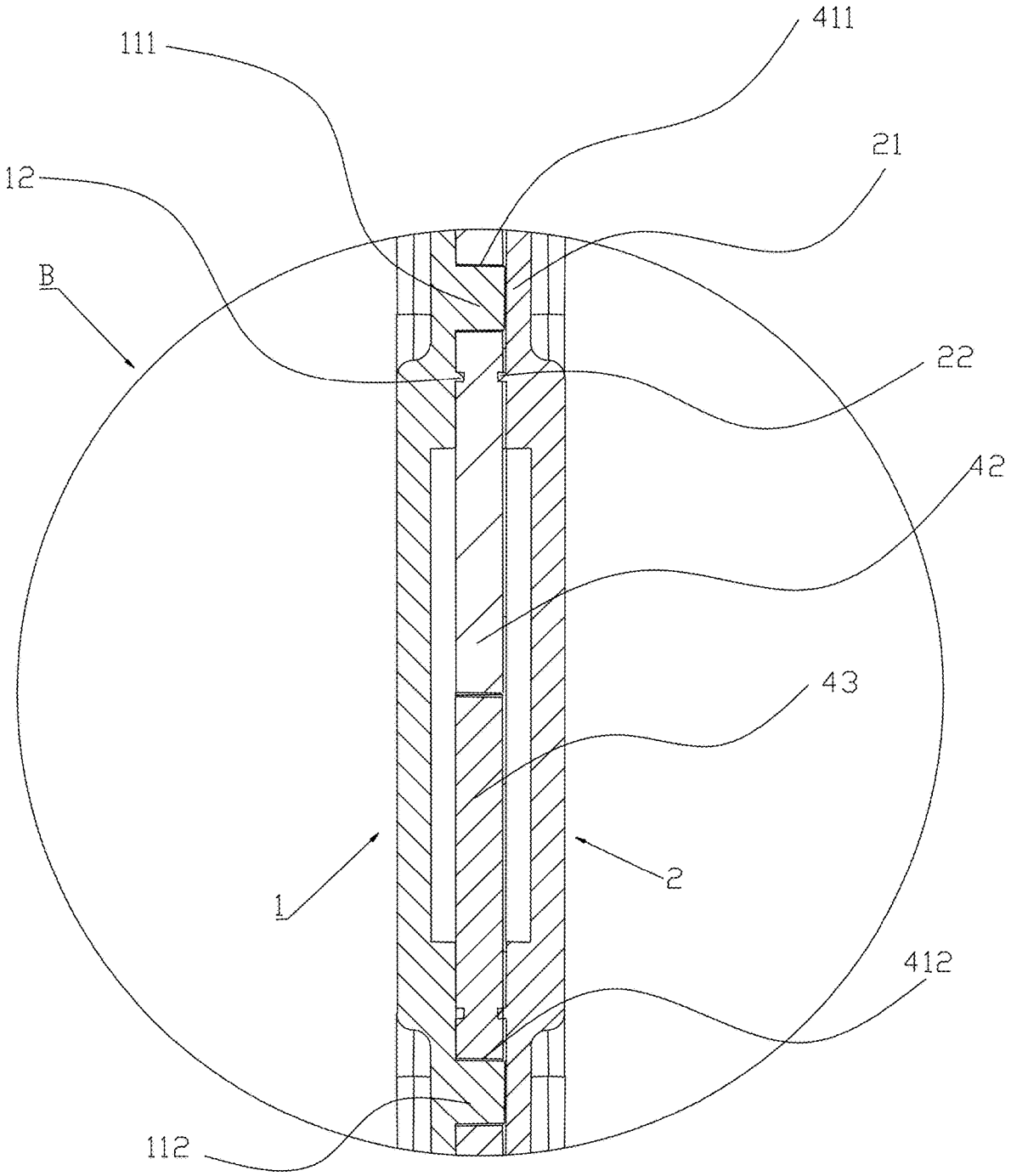
FIG. 18 is an enlarged diagram of the part B of FIG. 17.

Due to the arrangement of the above structure, during use, the clamping members 11 are connected to one another in sequence to form the mounting bracket 10. Angles between two edges of different types of clamping members 11 are different, so that magnetic toys in different shapes with the mounting brackets 10 can be formed, for example, a triangular magnetic toy, a rectangular attraction toy, a trapezoid attraction toy, or a hexagonal attraction toy. As shown in FIG. 10 to FIG. 12, users have more assembling choices on the magnetic toys in various shapes, which improves the fun of the product. The mounting columns 121 are arranged on the outer sides of the end portions of the clamping members 11. After all the clamping members 11 are connected, the clamping space 13 is formed between two opposite mounting columns 121. The magnet 22 is arranged in the iron tube 21. A first end of the iron tube 21 sleeves the mounting column 121 on one clamping member 11, and a second end of the iron tube 21 sleeves the mounting column 121 on the other clamping member 11. The two clamping members 11 are connected to stably connect the two ends of the iron tube 21 to the two mounting columns 121. When the magnet 22 is arranged in the iron tube 21, the magnet 22 can rotate in the iron tube 21. Under the action of a magnetic force, an orientation of a magnetic pole of the magnet 22 can be automatically adjusted. An N pole of one magnetic toy attracts an S pole of another identical magnetic toy, or an S pole of the magnetic toy attracts an N pole of the another identical magnetic toy, so as to achieve stable connection between the magnetic toys. Meanwhile, the iron tube can shrink magnetic induction lines around the magnet, so that the magnetic induction lines around the magnet are distributed more densely, and the magnetic induction intensity of a surface of the iron tube is improved. When two adjacent iron tubes get close to each other, a magnetic force between the two iron tubes is higher, which further improves the stability of connection of the magnetic toys and improves the use experience of a user. The base 301 and the cover body 302 are respectively connected to two sides of the mounting bracket 10, so that all the clamping members 11 can be fixed and are prevented from being separated from one another, which improves the stability of the product. Furthermore, the base 301, the cover body 302, and the mounting bracket can be in different colors. When the base 301 and the cover body 302 are connected to the two sides of the mounting bracket, edges of the clamping members are exposed between the base 301 and the cover body 302 to form a sandwich shape. There may be more colors matching each other, so that the product has a more attractive appearance and richer colors. Preferably, the base 301 and the cover body 302 are respectively connected to the two sides of the mounting bracket 10 in an ultrasonic welding manner. When ultrasonic waves act on thermoplastic plastic contact surfaces, tens of thousands of high-frequency vibrations per second will be generated. The high-frequency vibration waves are transmitted to a surface of the mounting bracket, a surface of the base 301, and a surface of the cover body 302. A local high temperature may be caused due to a high acoustic resistance at interfaces of the surface of the mounting bracket and the surfaces of the base 301 and cover body 302. As plastic has poor thermal conductivity, heat cannot be dissipated in time and is accumulated in a welding region. As a result, the interfaces of the surface of the mounting bracket and the surfaces of the base 301 and cover body 302 are quickly melted. Furthermore, a certain pressure is applied. After the action of the ultrasonic waves stops, the pressure is last for several seconds, so that the interfaces are solidified and molded. In this way, the mounting bracket, the base 301, and the cover body 302 form a whole. The welding purpose is achieved. The welding strength can be close to the strength of an original material. Moreover, welding lines can be reduced. In a case of guaranteeing the connection strength, the product has a more attractive appearance.

Due to the arrangement of the above structure, the base 301 and the cover body 302 are both provided with the gaps 31. When the base 301 and the cover body 302 are connected to the mounting bracket 10, the gaps 31 correspond to the clamping space 13. The iron tube 21 is exposed in the gaps 31, so that the magnetic members 20 of different magnetic toys are directly connected, which improves the magnetic force of the product and achieves high magnetic strength. The magnetic connection between two magnetic toys is more stable, and the use experience of a user is improved.

In this embodiment, abutment platforms 122 are arranged at joints of the mounting columns 121 and the clamping members 11; and when the iron tube 21 sleeves the mounting columns 121, end portions of the iron tube 21 abut against the abutment platforms 122. Due to the arrangement of the above structure, during use, the iron tube 21 sleeves the mounting columns 121 until the end portions of the iron tube 21 abut against the abutment platforms 122, and at this time, the iron tube 21 is at a mounting position. The abutment platforms can effectively restrict a sleeving depth of the iron tube 21 and restrict the position of the iron tube 21, thereby preventing damage to the iron tube 21 or the mounting columns 121 caused by improper mounting, and increasing the yield of the product.

In this embodiment, a diameter of a connecting end of each of the mounting columns 121 is greater than a diameter of a free end of the mounting column 121. Due to the arrangement of the above structure, a diameter of each of the mounting columns 121 gradually increases from its free end to its connecting end. To connect the mounting columns 121 to the iron tube 21, a user is allowed to plug the mounting columns 121 into the iron tube 21 more easily according to the relatively small diameters of the free ends of the mounting columns 121, so that the assembling efficiency is improved, and the yield of the product is increased.

In this embodiment, a guide cambered surface 123 is arranged at a free end of each of the mounting columns 121. Due to the arrangement of the above structure, to connect the mounting columns 121 to the iron tube 21, the guide cambered surfaces 123 are in contact with an inner wall of the iron tube 21, which further facilitates a user to plug the mounting columns 121 into the iron tube 21, and improves the production efficiency.

In this embodiment, the magnet 22 is columnar; a diameter of the magnet 22 matches an inner diameter of the iron tube 21; an axial direction of the magnet 22 matches an axial direction of the iron tube 21; and the magnet 22 rotates in the iron tube around the axial direction of the magnet. Due to the arrangement of the above structure, the columnar magnet 22 rotates in the iron tube 21 more easily. During use, the axial direction of the magnet 22 is basically parallel to the axial direction of the iron tube 21, and the diameter of the magnet 22 is slightly less than the inner diameter of the iron tube 21. Under the action of the magnetic force, the magnet 22 rotates, so that a direction of a magnetic pole of the magnet 22 matches a direction of an external magnetic field, which achieves free connection between magnetic blocks more easily and improves the use experience of a user.

In this embodiment, a connecting block 111 is arranged at a first end of each of the clamping members 11; a connecting slot 112 is formed in a second end of the clamping member 11; and the connecting block 111 on one of the clamping members 11 is plugged into the connecting slot 112 on the neighboring clamping member 11. After connection, a connection seam 128 is formed between the clamping members 11 and the neighboring clamping member 11 (referring to FIG. 3). Due to the arrangement of the above structure, the connecting block 111 on one clamping member 11 is connected to the connecting slot 112 on another clamping member 11, so that the two clamping members 11 are connected to each other, which can facilitate the assembling and connection of the clamping members and improve the assembling efficiency.

In this embodiment, one side of an axis of the magnet 22 is an S pole, and the other side of the axis of the magnet 22 is an N pole. Due to the arrangement of the above structure, the magnet 22 rotates around the axis to adjust orientations of magnetic poles. When two magnetic toys are connected to each other, under the action of the magnetic force, the magnets 22 rotate around the axes, so that the orientations of the magnetic poles of the magnets 22 can be automatically adjusted. An N pole of one magnetic toy and an S pole of the other identical magnetic toy attract together, or an S pole of the magnetic toy and an N pole of the other identical magnetic toy attract together, so as to achieve stable connection between the magnetic toys.

In this embodiment, a transverse length of the iron tube 21 is greater than a transverse length of the magnet 22; and a space exists between an end portion of the magnet 22 and a free end of each of the mounting columns 121. Due to the arrangement of the above structure, when the magnet 22 rotates around the axis, the space existing between the end portion of the magnet 22 and the free end of each of the mounting columns 121 can eliminate a friction force between the magnet 22 and the mounting column 121, so that the magnet 22 can rotate more easily around the axis, which conveniently adjusts the magnetic poles and facilitates the stable connection between the magnetic toys.

In this embodiment, a mounting convex block 32 is arranged on an inner side of the cover body 302; a mounting groove 33 is formed in an inner side of the base 301; and when the cover body 302 is connected to the other side of the mounting bracket 10 and is covered on the base 301, the mounting convex block 32 is plugged into the mounting groove 33. Due to the arrangement of the above structure, the base 301 and the cover body 302 are respectively connected to the two sides of the mounting bracket 10. The mounting convex block 32 is connected into the mounting groove 33. The mounting convex block 32 is stably connected to the mounting groove 33 in an ultrasonic welding manner, which improves the stability of the product and fixes all the clamping members 11. Furthermore, the base 301 and the cover body 302 can be transparent or semi-transparent, so that the mounting bracket 10 can be observed through the base 301 and the cover body 302, and the product is more attractive.

In this embodiment, a connecting portion 14 is arranged at a position, close to each of the mounting columns 121, of each of the clamping members 11 in a protruding manner; abutment blocks 34 are arranged on an inner side of the cover body 302 and/or an inner side of the base 301; and when the cover body 302 is connected to the other side of the mounting bracket 10 and is covered on the base 301, the abutment blocks 34 abut against an end surface of the connecting portion 14. Due to the arrangement of the above structure, when the base 301 and the cover body 302 are connected to the mounting bracket 10, the abutment blocks 34 abut against the end surface of the connecting portion 14, so that the base 301 and the cover body 302 are more stably connected to the mounting bracket 10, and positioning between the base 301, the cover body 302, and the mounting bracket 10 is achieved. The mounting is facilitated, and the stability of the product is improved.

In this embodiment, a connecting board 15 is arranged at an edge of each of the clamping members 11 in a protruding manner; and when the cover body 302 is connected to the other side of the mounting bracket 10 and is covered on the base 301, an outer edge of the cover body 302 and/or an outer edge of the base 301 abut against and are connected to an inner side of the connecting board 15. Due to the arrangement of the above structure, the outer edge of the cover body 302 and the outer edge of the base 301 abut against and are connected to the inner side of the connecting board 15, and the outer edge of the base 301 and the outer edge of the cover body 302 are connected to the inner side of the connecting board 15 in an ultrasonic welding manner, so that welding lines can be reduced, and stable connection can be achieved.

In this embodiment, connecting edges 35 are arranged at an edge of an outer surface of the cover body 302 and/or an edge of an outer surface of the base 301; and at least part of the connecting edges 35 abut against and are connected to an inner side of the connecting board 15. Due to the arrangement of the above structure, the connecting edges abut against the inner side of the connecting board 15, and the connecting edges 35 can be connected to the inner side of the connecting board 15 in an ultrasonic welding manner. The connecting edges 35 can improve the intensities of the base 301 and the cover body 302, which further improves the intensity of the product.

In this embodiment, reinforcing ribs 36 are arranged in the middle of a surface of the cover body 302 and/or in the middle of a surface of the base 301 in a protruding manner. Due to the arrangement of the above structure, the reinforcing ribs 36 are arranged in the middles of the base 301 and the cover body 302 in the protruding manner, so that the intensity of the product can be improved. Furthermore, the reinforcing ribs 36 in the middles of inner surfaces of the base 301 and the cover body 302 can be connected to a surface of the mounting bracket 10 in an ultrasonic welding manner or the like, which further improves the intensity of the product.

In this embodiment, connecting cambered surfaces 37 are arranged at an edge of an inner side of the cover body 302 and/or an edge of an inner side of the base 301; and the two connecting cambered surfaces 37 are connected to form a central through hole 40. Due to the arrangement of the above structure, the two connecting cambered surfaces 37 are connected to each other. The central through hole 40 is formed between inner surfaces of the connecting cambered surfaces 37, so that a hollowed magnetic toy can be formed. Magnetic toys with frames in various shapes are formed according to differences between the shapes of the clamping members 11 and the shapes of the base 301 and cover body 302.

In this embodiment, an arc-shaped transition surface 16 is arranged on an outer edge of each of the clamping members 11; and the arc-shaped transition surface 16 matches an outer surface of the iron tube 21. Due to the arrangement of the above structure, a radian of the arc-shaped transition surface 16 is basically consistent with a radian of the outer surface of the iron tube 21. When two magnetic toys magnetically attract each other, the arc-shaped transition surfaces of the two magnetic toys abut against each other, which further improves the stability of the product and facilitates a user to assemble the magnetic toys.

In this embodiment, a transition curved surface 151 is arranged at an edge of the connecting board 15; and the transition curved surface 151 is used to allow the connecting edges 35 to slide along the transition curved surface 151. Due to the arrangement of the above structure, during use, the base 301 and the cover body 302 are covered at two sides of the mounting bracket, and the connecting edges abut against the transition curved surface, so that the connecting edges of the base 301 and the cover body 302 to slide along the transition curved surface until the connecting edges abut against the inner side of the connecting board. In this way, the base 301 and the cover body 302 are quickly positioned on the mounting bracket, which facilitates a user to mount the base 301 and the cover body 302 and improves the production efficiency of the product.

In this embodiment, each of the clamping members 11 is a plastic clamping member.

Second Embodiment

Referring to FIG. 1 to FIG. 18, a magnetic attraction toy includes a base 1, a cover body 2, a magnetic attraction member 3 and a mounting frame 4. The magnetic attraction member 3 is connected with the mounting frame 4. The base 1 and/or the cover body 2 is provided with a limiting gap 5 for accommodating the magnetic attraction member 3. The magnetic attraction member 3 includes a hollow iron tube 31 and a magnet 32. The magnet 32 is located in the iron tube 31. One end of the iron tube 31 is provided with a first opening 311. The other end of the iron tube 31 is provided with a second opening 312. The mounting frame 4 includes a first clamping piece 42 and a second clamping piece 43. The first clamping piece 42 is provided with a first connection end 421 and a first clamping end 422. The second clamping piece 43 is provided with a second connection end 431 and a second clamping end 432. When the first clamping end 422 is plugged to the first opening 311, and the second clamping end 432 is plugged to the second opening 312, the first connection end 421 is connected to the second connection end 431, so that the first clamping piece 42 and the second clamping piece 43 clamp the iron tube 31, and the magnetic attraction member 3 and the mounting frame 4 are combined into a whole.

The base 1 is also provided with locating pillars 11. The mounting frame 4 is provided with locating holes 41. When the locating holes 41 sleeve the locating pillars 11, the cover body 2 is covered on the base 1 to stop the mounting frame 4 in the base 1 and to stop the magnetic attraction member 3 in the limiting gap 5.

A transverse length of the iron tube is greater than that of the magnet. Specifically, the transverse length of the iron tube is twice that of the magnet.

By means of the above structure, the magnetic attraction member can be exposed from the base and the cover body through the limiting gap. Compared with the prior art that a magnet is arranged in a plastic shell and fails in direct contact such that the magnetism is lowered, the present disclosure achieves direct contact between magnetic attraction toys, thus enhancing the first stage of magnetic force. Furthermore, the magnetic attraction member includes the iron tube and the magnet located in the iron tube, so that the transverse length of the iron tube can be set to be greater than that of the magnet. Specifically, the transverse length of the iron tube can be set to be twice that of the magnet, and the first clamping end and the second clamping end can be inserted into two ends of the iron tube, so that a magnetic attraction contact area between the magnetic attraction toys can be multiplied, and the magnet can still be fixed in a center position of the iron tube to provide a stronger and more stable magnetic attraction force, thus enhancing the second stage of magnetic force. In addition, the iron tube wrapping around the magnet makes magnetic induction lines around the magnet distributed intensively, so that the magnetic induction intensity around a surface of the magnetic attraction body becomes stronger, thus enhancing the third stage of magnetic force. A surface contact magnetic force of the magnetic attraction toy is enhanced by superposition of the enhancement of the three stages of magnetic forces, so that a user can put out a more three-dimensional, complicated and stable model using the magnetic attraction building blocks without increasing the cost for a strong magnet, and children's imagination can be developed more fully, which greatly increases the fun of experience of children. In addition, the first clamping piece and the second clamping piece are respectively clamped to two ends of the iron tube. On the one hand, the ribs welded with the first clamping piece and the second clamping piece are arranged on the base and the cover body, so that the number of welding lines is greatly increased, and a decrease in the quality of a product caused by difficulty in finding lack of weld is prevented. On the other hand, the thickness of an entire plastic building block is greatly increased, so that the overall torque resistance and tensile strength are greatly improved in order that children think a toy building block body cannot be broken with bare hands. A safety threat caused by the following fact can be effectively avoided: when playing the toy, a child swallows the magnet carelessly since a toy shell is broken. The safety of the magnetic attraction toy is then improved. Further, every country does not allow strong magnets to be exposed in children's products. The magnet is fixed in the iron tube. On the one hand, this regulation is met, and on the other hand, the magnetic attraction toys can be in direct contact through the surfaces of the iron tubes. Meanwhile, magnetic fields around the magnet are also strengthened.

In this embodiment, the base and the cover body can be provided with triangular, square, hexagonal, pentagonal, rhombus-shaped, trapezoid, fan-shaped or semicircular cross sections or cross sections in other shapes. When the base and the cover body can be provided with square cross sections, there are four magnetic attraction members and four mounting frames, which are respectively arranged on an upper side, lower side, left side and right side of the square base.

The first connection end 421 is a groove, and the second connection end 431 is a convex block matched with the groove 421. When the first clamping end 422 is plugged to the first opening 311, and the second clamping end 432 is plugged to the second opening 312, the convex block is connected with the groove. Specifically, the first clamping piece 42 and the second clamping piece 43 are both plastic clamping pieces. One end of the magnet 32 is an N pole, and the other end of the magnet 32 is an S pole. By means of the above structure, the magnetic attraction toy is simple in structure, reasonable in design and stable in connection, so that connection between the magnetic attraction member and the mounting frame is effectively achieved. Further, by means of the cooperation between the groove and the convex block, a position offset between the first clamping piece and the second clamping piece can be effectively prevented, so that the first clamping end of the first clamping piece and the second clamping end of the second clamping piece stably clamp the iron tube. Specifically, one end of the magnet is an N pole, and the other end of the magnet is an S pole, so that the N pole of the magnetic attraction toy can be easily guided to attract the S pole of another same magnetic attraction toy, and the S pole of the magnetic attraction toy can be guided to attract the N pole of another same magnetic attraction toy, so as to achieve stable connection between the magnetic attraction toys and facilitate the user to build a three-dimensional model. Further, the first clamping end 422 has a narrow front portion and a wide rear portion, and the second clamping end 432 has a narrow front portion and a wide rear portion, so that a first guide portion 423 is formed at a front end of the first clamping end, and a second guide portion 433 is formed at a front end of the second clamping end, and the first clamping end and the second clamping end can be inserted into the two ends of the iron tube to clamp the iron tube.

In this embodiment, the locating pillars 11 include a first locating pillar unit 111 and a second locating pillar unit 112. The locating holes 41 include a first locating hole unit 411 formed in the first clamping piece 42 and a second locating hole unit 412 formed in the second clamping piece 43. When the first clamping end 422 is plugged to the first opening 311 and the second clamping end 432 is plugged to the second opening 312, and when the first locating hole unit 411 sleeves the first locating pillar unit 111 and the second locating hole unit 412 sleeves the second locating pillar unit 112, the cover body 2 is covered on the base 1 to stop the first locating pillar unit 111 in the first locating hole unit 411 and stop the second locating pillar unit 112 in the second locating hole unit 412, so as to stop the mounting frame 4 in the base 1. The magnetic attraction member 3 is stopped in the limiting gap 5. The cover body 2 is provided with a stop edge 21. When the cover body 2 is covered on the base 1, the stop edge 21 abuts against the first locating pillar unit 111 and the second locating pillar unit 112 to stop the first locating pillar unit 111 in the first locating hole unit 411 and stop the second locating pillar unit 112 in the second locating hole unit 412, so that the magnetic attraction member 3 is stopped in the limiting gap 5. Specifically, a raised first rib 12 is also arranged on the base 1. When the first clamping end 422 is plugged to the first opening 311 and the second clamping end 432 is plugged to the second opening 312, and when the first locating hole unit 411 sleeves the first locating pillar unit 111 and the second locating hole unit 412 sleeves the second locating pillar unit 112, the first clamping piece 42 and the second clamping piece 43 are both connected with the first rib 12 by means of ultrasonic line welding. Further, a raised second rib 22 is arranged on the cover body 2. When the first locating hole unit 411 sleeves the first locating pillar unit 111 and the second locating hole unit 412 sleeves the second locating pillar unit 112, and when the cover body 2 is covered on the base 1, the first clamping piece 42 and the second clamping piece 43 are both connected with the second rib 22 by means of ultrasonic line welding. Much further, when the cover body is covered on the base, a first stop edge abuts against a first locating pillar and a second locating pillar to stop and press the first clamping piece and the second clamping piece to the base, so that the magnetic attraction member is stopped in the limiting gap. By means of the above structure, connection among the magnetic attraction member, the mounting frame and the base is effectively achieved. The mounting frame is stably fixed on the base by connecting the locating holes of the mounting frame to the locating pillars on the base in a sleeving manner. The first clamping piece and the second clamping piece are both connected with the first rib by means of the ultrasonic line welding, and the first clamping piece and the second clamping piece are both connected with the second rib by means of the ultrasonic line welding, so that the first clamping piece and the second clamping piece are stably mounted between the cover body and the base; the first clamping piece and the second clamping piece can be effectively prevented from being separated from the locating pillars, thus preventing the magnetic attraction member clamped by the first clamping piece and the second clamping piece from being separated from the limiting gap; and the situation that a child carelessly swallows the loosened magnetic attraction member is prevented, thus further improving the safety and stability of the magnetic attraction toy. Furthermore, a three-dimensional model built using the magnetic attraction toy is more stable. Further, by means of adding the first rib and the second rib inside, the welding area is enlarged, the process risk of lack of weld is effectively avoided, the quality of a product is improved, and the reject ratio of products is reduced.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A magnetic suction toy, comprising:

a mounting bracket, wherein the mounting bracket comprises a plurality of clamping members; two adjacent clamping members are connected to form the mounting bracket; a clamping portion is arranged at an end portion of each of the clamping members; a clamping space is formed between the two clamping portions on the two adjacent clamping members; the clamping portions are provided with mounting columns; the mounting columns are arranged in a manner of facing the mounting space;

a magnetic member, wherein the magnetic member comprises a cylindrical iron tube and a magnet, the iron tube defines a first opening at a first end and a second opening at an opposite second end, and the iron tube has a closed circle in cross section; the magnet is rotatably arranged in the iron tube; two adjacent mounting columns in the clamping space are respectively clamped to two ends of the iron tube;

a base, wherein the base is connected to one side of the mounting bracket; and a cover body, wherein the cover body is connected to the other side of the mounting bracket and is covered on the base;

wherein two adjacent clamping members can be assembled so that mounting columns are engaged in the first opening and the second opening, thus fixing the magnetic member in the clamping space;

wherein the base and the cover body are both provided with gaps; the gaps correspond to the clamping space; and when the base and the cover body are connected to the mounting bracket, at least part of the iron tube is arranged into the gaps.

2. The magnetic suction toy according to claim 1, wherein the base is further provided with a positioning column; the mounting bracket is provided with a positioning hole; when the positioning hole sleeves the positioning column, the cover body is covered on the base to top the mounting bracket in the base and to stop the magnetic member in the gaps.

3. The magnetic suction toy according to claim 2, wherein the positioning column comprises a first positioning column unit and a second positioning column unit, the positioning hole comprises a first positioning hole unit and a second positioning hole unit, the cover body is provided with a stop edge; and when the cover body is covered on the base, the stop edge abuts against the first positioning column unit and the second positioning column unit to stop the first positioning column unit in the first positioning hole unit and stop the second positioning column unit in a second positioning hole unit, so that the magnetic member is stopped in the gaps.

4. The magnetic suction toy according to claim 1, wherein abutment platforms are arranged at joints of the mounting columns and the clamping members; and when the iron tube sleeves the mounting columns, end portions of the iron tube abut against the abutment surface of the abutment platforms.

5. The magnetic suction toy according to claim 1, wherein a diameter of a connecting end of each of the mounting columns is greater than a diameter of a free end of the mounting column.

6. The magnetic suction toy according to claim 2, wherein a guide cambered surface is arranged at a free end of each of the mounting columns.

7. The magnetic suction toy according to claim 1, wherein the magnet is columnar; a diameter of the magnet matches an inner diameter of the iron tube; an axial direction of the magnet matches an axial direction of the iron tube; and the magnet rotates in the iron tube around the axial direction of the magnet.

8. The magnetic suction toy according to claim 1, wherein a connecting block is arranged at a first end of each of the clamping members; a connecting slot is formed in a second end of the clamping member; and the connecting block on one of the clamping members is plugged into the connecting slot on the neighboring clamping member.

9. The magnetic suction toy according to claim 7, wherein one side of an axis of the magnet is an S pole, and the other side of the axis of the magnet is an N pole.

10. The magnetic suction toy according to claim 1, wherein a transverse length of the iron tube is greater than a transverse length of the magnet; and a space exists between an end portion of the magnet and a free end of each of the mounting columns.

11. The magnetic suction toy according to claim 1, wherein a mounting convex block is arranged on an inner side of the cover body; a mounting groove is formed in an inner side of the base; and when the cover body is connected to the other side of the mounting bracket and is covered on the base, the mounting convex block is plugged into the mounting groove.

12. The magnetic suction toy according to claim 1, wherein a connecting portion is arranged at a position, close to each of the mounting columns, of each of the clamping members in a protruding manner; abutment blocks are arranged on an inner side of the cover body and/or an inner side of the base; and when the cover body is connected to the other side of the mounting bracket and is covered on the base, the abutment blocks abut against an end surface of the connecting portion.

13. The magnetic suction toy according to claim 1, wherein a connecting board is arranged at an edge of each of the clamping members in a protruding manner; and when the cover body is connected to the other side of the mounting bracket and is covered on the base, an outer edge of the cover body and/or an outer edge of the base abut against and are connected to an inner side of the connecting board.

14. The magnetic suction toy according to claim 13, wherein connecting edges are arranged at an edge of an outer surface of the cover body and/or an edge of an outer surface of the base; and at least part of the connecting edges abut against and is connected to an inner side of the connecting board.

15. The magnetic suction toy according to claim 14, wherein a transition curved surface is arranged at an edge of the connecting board;

and the transition curved surface is used to allow the connecting edge to slide along the transition curved surface.

16. The magnetic suction toy according to claim 1, wherein reinforcing ribs are arranged in the middle of a surface of the cover body and/or in the middle of a surface of the base in a protruding manner.

17. The magnetic suction toy according to claim 1, wherein connecting cambered surfaces are arranged at an edge of an inner side of the cover body and/or an edge of an inner side of the base; and the connecting cambered surfaces are connected to form a central through hole.

18. The magnetic suction toy according to claim 1, wherein an arc-shaped transition surface is arranged on an outer edge of each of the clamping members; and the arc-shaped transition surface matches an outer surface of the iron tube.

19. The magnetic suction toy according to claim 1, wherein the mounting columns are arranged along an extending direction of the iron tube.

20. The magnetic suction toy according to claim 1, further comprising a connection seam between the two adjacent clamping members.

* * * * *